US006655687B2

(12) United States Patent
Sanchez-Seco

(10) Patent No.: US 6,655,687 B2
(45) **Date of Patent: *Dec. 2, 2003**

(54) ARRANGEMENT FOR TABLE GAME BOARDS

(76) Inventor: Encarnacion Orgaz Sanchez-Seco, Gutierre de Cetina, 30-28017 Madrid Spain (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 7 days.

(21) Appl. No.: 09/526,587

(22) Filed: Mar. 16, 2000

(65) Prior Publication Data

US 2002/0140169 A1 Oct. 3, 2002

(30) Foreign Application Priority Data

Jul. 29, 1999 (ES) ..... 9902031 U

(51) Int. Cl.[7] ..... A63F 71/00

(52) U.S. Cl. ..... 273/271; 273/144 R; 273/144 B; 273/142; 273/271; 273/287; 273/148

(58) Field of Search ..... 273/148, 144 R, 273/144 B, 142 E, 142 F, 142 G, 126 R, 121 D, 271, 287, 148 R

(56) References Cited

U.S. PATENT DOCUMENTS 1,722,986 A * 7/1929 McAlice ..... 273/144 R
2,711,900 A * 6/1955 Tressler ..... 273/138
D276,447 S * 11/1984 Escamilla-Kelly ..... D21/20
4,651,996 A * 3/1987 Watkins, Jr. ..... 273/271
5,011,148 A * 4/1991 Stebing ..... 273/144 B
6,279,903 B1 * 8/2001 Mendes, Jr. et al. .... 273/121 B
2001/0009316 A1 * 7/2001 Krise et al. ..... 273/108

FOREIGN PATENT DOCUMENTS

ES 224341 * 11/1976

OTHER PUBLICATIONS

PLINKO, Jan. 3, 1983—Present, wysiwyg://222/http://meltingpot.fortunecity.com/harrow/953/plinko.htm—pp. 1–9.*

* cited by examiner

*Primary Examiner*—Benjamin H. Layno
*Assistant Examiner*—Dolores R. Collins
(74) *Attorney, Agent, or Firm*—Alfred M. Walker

(57) ABSTRACT

A game board has a pair of vertically extending panels with channels separated by partitions therebetween. The game board also has internal channels with curved protrusions and occasional open spaces between them such that a game disk may be deviated from the channel into which it were introduced into an adjacent channel. In addition, curved protrusions in the bottom may cause a game disk to pass from one channel to a next one, thereby providing a degree of player enhancement and heightened experience of chance.

3 Claims, 1 Drawing Sheet

ARRANGEMENT FOR TABLE GAME BOARDS

FIELD OF THE INVENTION

The field of this invention is the manufacture of toys and accessories for table games.

BACKGROUND OF THE INVENTION

The applicant is aware of the existence of a Utility Model applied for in Spain with No. 224,341 on Nov. 9, 1976 under the name of Jose Salazar Fernandez, called the ABILITY GAME.

The mentioned ability game consists of a vertical board formed by two rectangular parallel sides aligned with each other and separated by several parallel and vertical partition walls. Flat and vertical passages were thereby configured, and in each one there were transversely passing holes arranged symmetrically.

The upper horizontal edge of the game board is open while the lower horizontal edge is closed by a bottom which can slide to one edge to permit lower removal of game disks. Alternatively, the game disks introduced by the two players in the various vertical channels can be removed by shaking the board.

The invention in question has game disks in two different colors, 21 for each player, the number of disks being similar to the number of perforations existing in the rear and front faces of the board. The game disks have a size suitable for the width of the channels or passages and a thickness according to the separation the two parallel sides or faces. The diameter of the holes in registration on the front and rear faces and their separation corresponding to the diameter of the game disks, permits the disks to be visible and therefore observable by both players so that each player may try to prevent the opponent from placing four game disks in a straight line consecutively in a horizontal, vertical or inclined position.

However, the applicant is unaware of the current existence of a board for table games having an arrangement such that internal obstacles not visible to either player cause deviations in the expected vertical path of the game disks to cause transference to alternate channels and even to penetrate blind channels.

OBJECT OF THE INVENTION

The present specification relates to an improved arrangement for table game boards. The improvement over table game boards known as "four in a line" lies in a series of challenges which involve the heightened awareness of the players requiring memory, reflexes and personal initiative to overcome the impediments presented by internal curved protrusions, blind channels, and deviation ramps which cause game disks introduced by players lacking concentration to pass to unintended areas. By concentrating, a player can compensate for these internal deviations to achieve the final purpose of locating the four of the game disks in the alignment necessary to win the game.

SUMMARY OF THE INVENTION

The improved arrangement for table game boards proposed by this invention provides novel features which obliges the players to exhibit constant concentration in order to play in a competitive manner.

More specifically, the game board of this invention while externally similar in configuration to known game boards, has internal channels with curved protrusions and occasional open spaces between them such that a game disk may be deviated from the channel into which it were introduced into an adjacent channel. In addition, curved protrusions in the bottom may cause a game disk to pass to a next one.

Likewise, the partition walls may have curved protrusions causing the game disk introduced in a descending vertical direction to pass automatically to the adjacent channel and from this, to remain in position if blocked by previously placed game disks in the bottom, or if free to move, to pass down some steps toward the lower area.

Likewise, at least one blind channel has been arranged such that the player introducing a disk in it will practically lose it.

Also, the lower area has a ramp which, through openings in the channel walls, may cause a game disk introduced in a channel situated on the right to pass to the central area or to the lower area of a channel situated three or four columns to the left.

The invention also has various support components. It is unloaded through the top edge where the players introduce the game disks.

DETAILED DESCRIPTION OF THE PREFERRED EMBODIMENT OF THE INVENTION

Figure 1:
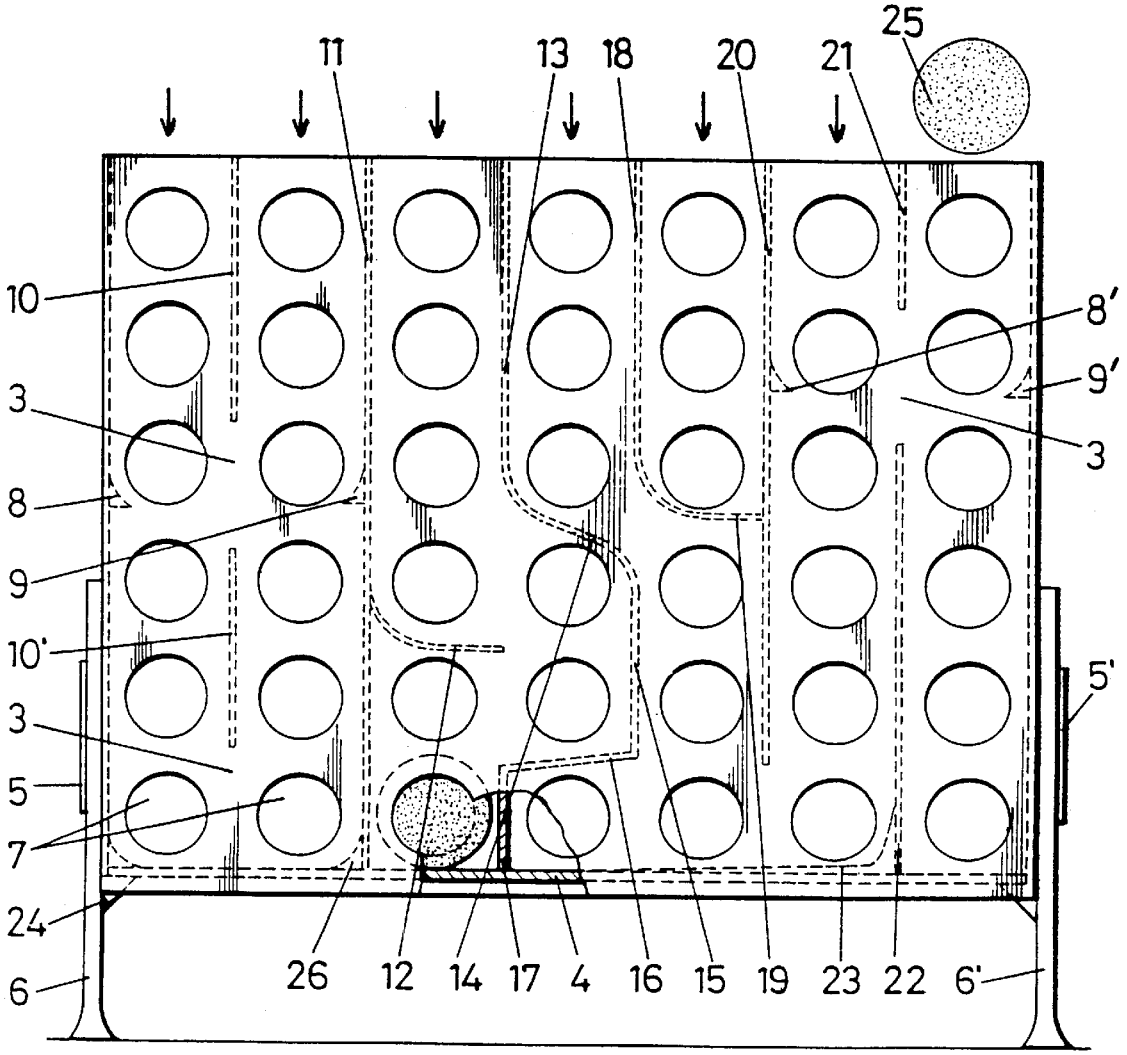
FIG. 1 is a front elevation view of an improved arrangement for table game boards of this invention.
Figure 2:
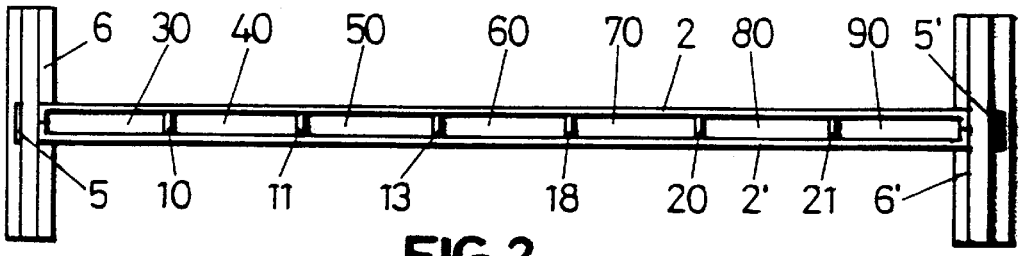
FIG. 2 is a top plan view of the object represented in FIG. 1.

FIGS. 1 and 2 illustrate the improved arrangement for table game boards of this invention. Two rectangular face panels 2 and 2' are joined at their ends to two supports 6 and 6' with the help of lugs 5 and 5'. This arrangement places face panels 2 and 2' in a vertical position with partition walls 10, 11, 13, 18, 20 and 21 therebetween in an interior space of constant depth.

The mentioned partitions produce seven vertical channels 30, 40, 50, 60, 70, 80 and 90 numbered from left to right respectively, having a similar width as well as an identical length.

Each one of the face panels 2 and 2' has forty-two circular perforations identical to each other and which are in exact registration on face panels 2 and 2'. The mentioned channels permit the introduction and sliding of game disks 25 with an appropriate thickness and diameter to slide along the channels. Game disks 25 have diameters slightly greater than perforations 7 and can be moved from one channel to another due to the existence of obstacles, when occurring.

Channel 30 located on the left side presents a curved protrusion 8 at the lower left area of the third opening 7. When game disk 25 hits protrusion 8, it is displaced to the right whereupon it may pass from channel 30 to channel 40 through a gap between the lower portion of partition 10 and its extension 10'.

Likewise in the lower area of channel 30 another curved protrusion 24 similar to 8 is placed at the left edge permitting a game disk to pass to another place.

Channel 40 has a curved protrusion 9 at a similar height protrusion 8 involving the possible deviation of game disk 25 when introduced in channel 40. In the lower right area of channel 40, a curved protrusion 26 is placed similar in function to that numbered 24.

In channel 50, separated by a longitudinal partition wall 11 there is a curved deviation 12 at the height of the fourth perforation from the upper to the lower area, which automatically guides game disk 25 to the lower area of channel 60.

Channel 60 has a curved deformation at the height of the third perforation in a descending vertical direction, forming a channel that permits the passage of game disk 25 toward channel 70, channel 60 being separated from 70 by partition wall 18. Partition wall 13 having straight portion 15 after curved area 14 has in its lower area a straight deviation 16 toward the left forming steps with a partition wall 17 constituting the lower area of partition wall 13.

Partition wall 18, has a curved deformation 19 which terminates on the left face of partition wall 20 thereby forming a blind end preventing the game disk 25 from being moved.

Over partition wall 20, which is open at its bottom area, there is a gap opening 3 having a curved protrusion 8' which likewise produces the potential of moving game disk 25 toward channel 70, on being introduced through 80, there existing in the bottom part of channel 80 a ramp 23 terminating in the lower area of channel 60 to this purpose. A game disk introduced through channel 80 is thus displaced through the lower part ending up in the lower area of channel 60, if the lower areas of channels 60 and 70 are clear.

Finally, channel 90 formed by the upper partition wall 21 parallel to 20 and its extension 22 has a curved protrusion 9' at a similar height to protrusion 8' in channel 80.

As a consequence of the above, it is clearly evident that there exist multiple difficulties to be overcome by the players due to the varied arrangements of obstacles existing inside.

It is not considered necessary to further extend this description for anyone skilled in the art to understand the scope of the invention and the advantages derived from it.

The materials, shape, size and arrangement of the components may be varied, provided that this does not involve an essential change of the invention.

The terms in which this specification has been described should always be interpreted in the widest and non-limiting sense.

I claim:

1. An improved arrangement for a table game board comprising a plurality of hidden playing discs movable between a pair of vertically extending perforated opaque panels (2) and (2') said pair of perforated opaque panels (2) and (2') having open perforations temporarily exposing each respective hidden playing disc of said plurality of hidden playing discs to view, which said perforated opaque panels (2) and (2') adopt a rectangular configuration, said perforated opaque panels (2) and (2') laterally providing with a pair of lugs (5) and (5') which are coupled over grooves in a pair of legs (6) and (6'), placing said vertically extending perforated opaque panels (2) and (2') vertically, wherein a lower part (4) of said arrangement closes respective lower horizontal parts of said vertically extending perforated opaque panels (2) and (2'), forming an internal hidden hollow space therebetween, each one of said vertically extending perforated opaque panels (2) and (2') having a plurality of vertically positioned open perforations (7) in each respective surface thereof, each of said open perforations (7) matching opposite each other when placed in front of each other, said open perforations (7) being circular holes, said open perforations (7) extending from a first top most open perforation respectively downward to a sixth lowermost open perforation, wherein further between said vertically extending perforated opaque panels (2) and (2') a plurality of hidden blind interrupted vertically extending channels (30), (40), (50), (60), (70), (80) and (90) are formed in a row, each said hidden blind interrupted vertical channel being identical in width and thickness, as well as in length and number, said hidden blind interrupted vertical channels being separated by a plurality of respective hidden discrete vertically extending partition walls (10), (11), (13), (18), (20) and (21), said hidden discrete vertically extending partition walls (10), (11), (13), (18), (20) and (21) forming said hidden blind interrupted vertical channels (30) (40), (50), (60), (70), (80) and (90), a first one of said hidden blind interrupted vertical channels (30) being situated on a left side of said perforated opaque panels having a protrusion (8) protruding at a similar height corresponding to a lower area of a third open perforation (7) in a descending vertical direction, extending down respective from a top edges of each of said vertically extending perforated opaque panels (2), (2'), said board having a hidden space (3) without a partition wall existing beyond a first hidden discrete vertically extending partition wall (10), said first discrete vertically extending partition wall (10) separated from and continuing in a similar first hidden discrete vertically extending, partition wall (10') and there being provided an opening (3) in said lower part, there being a second protrusion (24) similar to first protrusion (8) in a lower left top of said hidden blind interrupted vertical channel (30), each said hidden blind interrupted vertical, channel being interrupted by an opening leading to a respective longitudinally extending extension deviating from a respective hidden discrete vertically extending partition wall, each said respective longitudinally extending extension diverting a hidden transit path of a respective disc of said plurality of discs from within one of said hidden blind interrupted vertical channels to another adjacent hidden blind interrupted vertical channel, and one of said discrete vertically extending partition walls being provided with a trap for a disk, which prevents said disks from dropping any lower.

2. An improved arrangement for a table game board, according to claim 1, wherein a second hidden blind interrupted vertical channel (40) is configured by a second hidden discrete vertically extending partition wall (11) situated adjacent said first hidden discrete vertically extending partition wall (10) and said first hidden discrete vertical partition wall (10') exhibits a further protrusion (a) at first similar height to said protrusion (8), a protrusion (9) being further provided, there being in said lower area a fourth protrusion (26) similar to said second protrusion (24) provided in said lower area of said first hidden blind interrupted vertical channel (30).

3. A table game to be played by two players comprising a pair of spaced, vertically extending opaque front and rear panels said opaque panels having a plurality of generally vertically extending channels formed therebetween by generally vertically extending partition walls, each channel with an entrance at a top end of said panels, a plurality of perforations formed into rows and columns in said front panel, the columns of said perforations corresponding with said channels, and the rows of said perforations being equispaced, a plurality of disks having a different color for each player for being deposited into the entrances of said channels at the top end of said panels, and said partitions having diverting sections and openings for trapping and transferring said disks from one channel to another channel, one of said discrete vertically extending partition walls being provided with a trap for a disk, which prevents said disks from dropping any lower, said disks when coming to rest being aligned with one of said perforations so that each player can observe alignment of disks of his own color in said perforations as the game progresses.

* * * * *